US005980207A

United States Patent [19]

Correll

[11] Patent Number: 5,980,207

[45] **Date of Patent: *Nov. 9, 1999**

[54] BACKWARD INCLINED FAN IMPELLER

[75] Inventor: J. David Correll, Avon, Ohio

[73] Assignee: Xerxes Corporation, Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,817

[22] Filed: Aug. 20, 1997

[51] Int. Cl.[6] ..... F04D 29/38

[52] U.S. Cl. ..... 416/186 R; 416/188

[58] Field of Search ..... 416/186 R, 188

[56] References Cited

U.S. PATENT DOCUMENTS

| | | | |
|---|---|---|---|
| 3,224,079 | 12/1965 | Dybvig | 416/186 |
| 4,363,601 | 12/1982 | Leskinen | 416/188 |
| 4,647,271 | 3/1987 | Nagai et al. | 416/188 |
| 5,336,050 | 8/1994 | Guida et al. | 416/186 |
| 5,558,499 | 9/1996 | Kobayashi | 416/186 |
| 5,588,803 | 12/1996 | Vetter et al. | 416/186 |

FOREIGN PATENT DOCUMENTS

| | | | |
|---|---|---|---|
| 338436 | 8/1920 | Germany | 416/186 |
| 1503584 | 7/1970 | Germany | 416/188 |

*Primary Examiner*—John Kwon
*Attorney, Agent, or Firm*—Long, Aldridge & Norman, LLP; Steven B. Kelber

[57] ABSTRACT

A backward inclined fan impeller features a plurality of blades attached to a shroud ring and base for use in transporting corrosive materials. The impeller assembly is substantially corrosion resistant while maintaining adequate performance characteristics. Rotary power actuates the impeller assembly.

8 Claims, 3 Drawing Sheets

BACKWARD INCLINED FAN IMPELLER

BACKGROUND OF THE INVENTION

1. Field of the Invention

This invention concerns an impeller used in the field of fluid transfer using rotating machinery. The invention more particularly concerns an impeller specifically developed for use with corrosive fluids while maintaining standard performance characteristics.

2. Discussion of the Background

Traditional impellers employ blades to transfer the fluid from an inlet, or suction eye, through the interior of the impeller and then discharged through an outlet. The blades of the impeller can be oriented relative to the axis of rotation of the impeller in a radial direction, a forwardly inclined direction, or a backwardly inclined direction. The forwardly inclined blade design employs a blade which has an exit edge which is forward of the inlet edge of the blade relative to the direction of rotation of the impeller. For example, relative to a fixed rectangular coordinate system located at the axis of rotation of the impeller, but not fixed to the impeller, the exit edge of the blade crosses any one of the coordinate axes before the inlet edge of the blade crosses the corresponding coordinate axis when the impeller is rotated. Likewise, the backwardly inclined blade design employs a blade which has an inlet edge forward of the exit edge of the blade relative to the direction of rotation of the impeller. The backwardly inclined blade design is more efficient than either the radial or forwardly inclined blade designs.

However, backwardly inclined blade designs have a major drawback over the other two types of blade orientation in that the blade stresses are much greater. The larger stresses have tended to require that the material of construction of the blades be restricted to steel due to its high strength, stiffness, and fatigue characteristics. As such, the steel blades allow for blade angles and contours which maintain good flow characteristics and performance characteristic.

The steel blades are adequate for many uses and environments. However, when steel impellers are employed to transmit corrosive materials, the steel impellers corrode. The steel impellers employed to transmit the corrosive fluids work satisfactorily for a short period of time before the corrosive effect of the working fluid corrodes the steel impeller to the point of uselessness. To overcome the problem of corrosion to the material of the impeller, fiberglass reinforced plastic has been employed since fiberglass reinforced plastic has superior corrosion resistant properties as compared to steel.

However, the large stresses mentioned earlier require that either the thickness of the blades be increased or the angle of inclination be compromised. Furthermore, increasing the thickness of the blades increases the mass moment of inertia of the impeller thus requiring increased operational power, limits the number of blades that can be placed on the impeller, and adversely affects blade aerodynamics.

SUMMARY OF THE INVENTION

It is an object of the invention to provide an impeller that transmits corrosive fluids while maintaining corrosion resistance and performance characteristics.

In one form of the invention the backward inclined fan impeller takes the form of a plurality of backwardly inclined blades attached to a base. Attached to another side of the blades is a shroud ring. The shroud ring has an opening in its center forming a suction eye. Attached to the center of the base is a conical hub. The blades are made from corrosion resistant material.

Thus, Applicant's invention is superior to the prior art. Applicant's invention provides for a backwardly inclined fan impeller which is able to operate in a corrosive environment while maintaining performance characteristics. Applicant's invention achieves this objective by employing a substantially corrosion resistant fiberglass reinforced plastic as the material of construction in combination with a conical hub, a shroud ring, a base, and blades so as to minimize stresses within the blades while maintaining efficient blade aerodynamics. The impeller is efficient because of the backward inclined orientation of the blades, the relatively thin blade width, and the use of the conical hub and shroud ring to alter the direction of the fluid flow. The blades of the impeller assembly are structurally sound since the blades are integrally connected to both the base and the shroud ring. The prior art fails to disclose the use of such structural features which provide the desired result. Such structural features distinguish Applicant's invention, structurally and functionally, over the prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
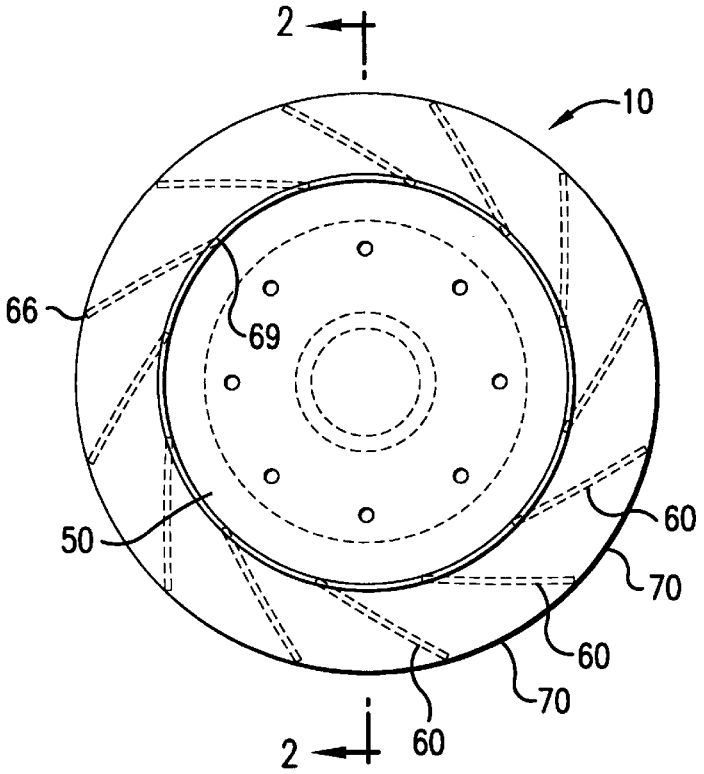
FIG. 1 is a top view of the impeller assembly, the blades are shown in phantom line.

Referring now to the drawings, wherein like reference numerals designate identical or corresponding parts throughout the several views, and more particularly to FIG. 1 thereof, an impeller assembly 10 has been created which provides for the transmission of corrosive fluids while maintaining conventional performance characteristics. The embodiment of this invention is displayed in FIGS. 1 and 2. FIGS. 3–8 show details of various parts of the impeller assembly 10.

FIG. 1 is a top view of the impeller assembly 10 where the blades 60 are shown in phantom line, the hub assembly 30 is also shown in phantom line, and the conical hub or portion 50 is also shown. FIG. 1 illustrates the placement of eight screws (not numbered) equally spaced around a mid portion of the conical hub 50 so as to secure the conical hub 50 to the base 40 (not shown), and the hub assembly 30 (not numbered). FIG. 1 further illustrates use of backwardly inclined blades 60 which are located equidistant from each other along the base 40 (not shown) creating an annular array of impeller blades. The blades 60 are radially located between the outer periphery 52 of the conical hub 50 and the outer periphery of the base 40 (not shown). The impeller assembly 10 as shown in FIG. 1 rotates in operation in a clockwise direction. Outlets 70 are located between each adjacent set of blades 60.

Figure 2:
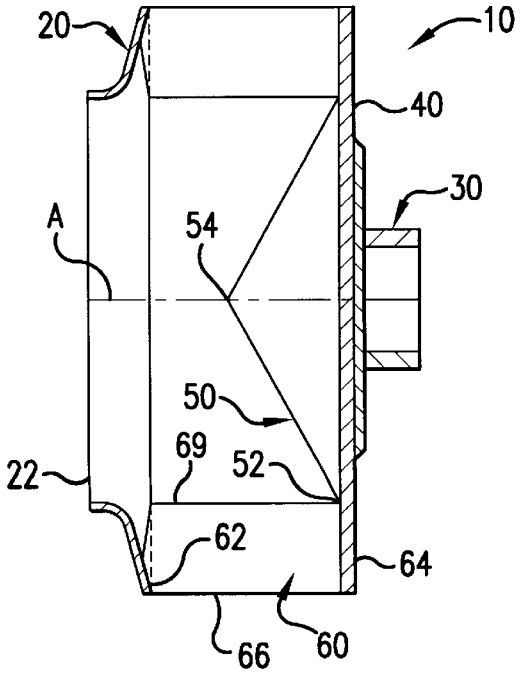
FIG. 2 is a partial cross-sectional side view of the impeller assembly taken along line 2—2 of FIG. 1, showing some of the elements interior of the impeller assembly.

FIG. 2 is a partial cross-sectional side view of the impeller assembly 10 taken along line 2—2 of FIG. 1. FIG. 2 clearly shows the conical shape of the conical hub 50. FIG. 2 further illustrates the location of the base 40 on which the conical hub 50 is mounted. Likewise, the base 40 is mounted on the hub assembly 30. The shroud ring 20 connects to each of the blades 60. Suction eye 22 of the shroud ring 20 introduces the corrosive fluid into the impeller to eventually be discharged through the outlets 70. The impeller assembly rotates about a rotational axis A.

Figure 3:
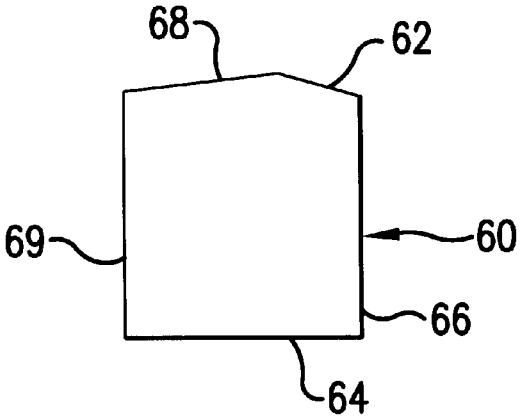
FIG. 3 is a side view of a blade.

FIG. 3 shows a side view of a blade 60 which has an outlet edge 66, a straight connecting edge 64, a free edge 68, an inlet edge 69, and an inclined connecting edge 62. The free edge 68 and inclined connecting edge 62 are located at one axial end of the blade 60. The straight connecting edge 64 is located at the other axial end of the blade 60.

Figure 4:
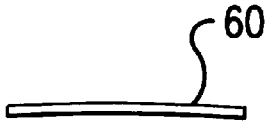
FIG. 4 is a top view of a blade.

FIG. 4 shows a top view of a blade 60. The top view displays the relative thickness of a blade 60.

Figure 5:
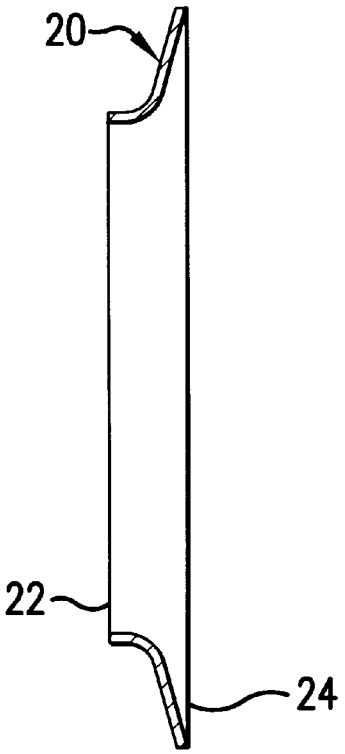
FIG. 5 is a cross-sectional side view of a shroud ring.

FIG. 5 is a cross-sectional side view of the shroud ring 20. The suction eye 22 of the shroud ring 20 is clearly displayed. The corrosive material which enters through the suction eye 22 exits the shroud ring 20 through a flared end 24.

Figure 6:
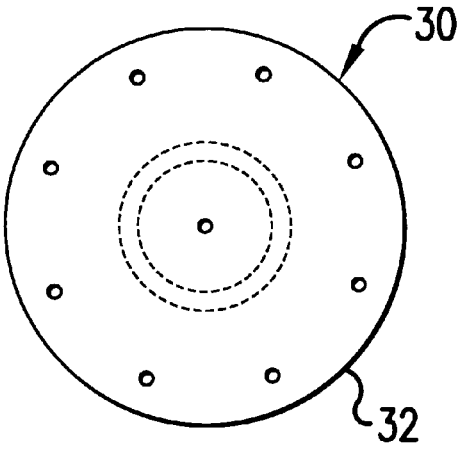
FIG. 6 is a top view of a hub and flange assembly.

FIG. 6 is a top view of the hub assembly 30. Specifically, the flange 32 of the hub assembly 30 is displayed showing the matching screw-hole pattern that matches the screw-hole pattern shown in FIG. 1.

Figure 7:
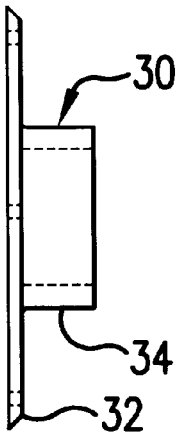
FIG. 7 is a side view of the hub and flange assembly.

FIG. 7 is a side view of the hub assembly 30 which shows the flange 32 and the hub 34. The hub 34 is designed so as to receive rotary power from a power source (not shown). The hub assembly 30 is ideally made out of cold rolled steel plate.

Figure 8:
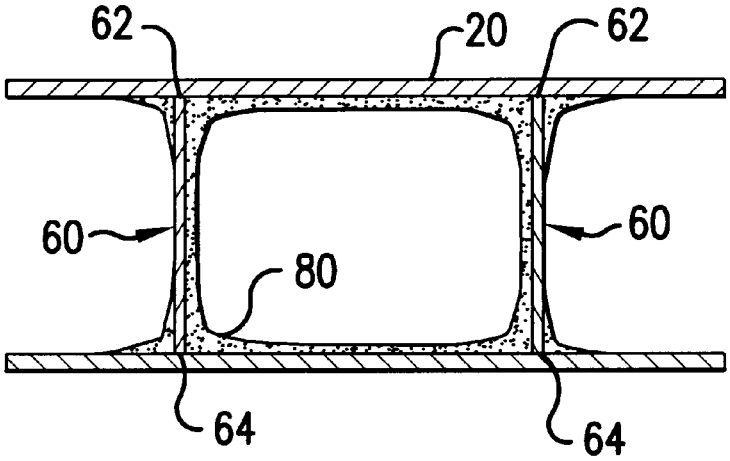
FIG. 8 is a cross-sectional side view of an assembly of a blade to the base and to the shroud ring.

FIG. 8 is a cross-sectional side view of an assembly of a blade 60 to the base 40 and to the shroud ring 20. FIG. 8 illustrates how attachment material 80 composed of a mixture of fiberglass and plastic is applied to the blades 60, shroud ring 20, and the base 40.

Components, other than the hub assembly 30, are ideally made from fiberglass reinforced plastic.

The inclined connecting edge 62 of each blade 60 connects to an inner surface of the shroud ring 20 at its flared end 24, as shown in FIGS. 2 and 8. Once the blades 60 and shroud ring 20 abut each other the attachment material 80 which consists of a mixture of fiberglass and plastic is applied to the surfaces of the blade 60 and shroud ring 20 so as to overlap the surfaces and blend them together. Also, as shown in FIGS. 2 and 8 are the connection of the blade 60 to the base 40. The straight connecting edge 64 of each blade 60 is brought into contact with a surface of the base 40. The outlet edge 66 of the blade 60 is placed perpendicularly adjacent to the outer periphery of the base 40 and the inlet edge 69 of the blade 60 is placed adjacent to the outer periphery of the conical hub 50.

Again, the attachment material 80 composed of a mixture of fiberglass and plastic is applied so as to overlap the surfaces of the base 40 and blades 60. Additionally, the attachment material 80 is blended into the corners created by the attachment of the blades 60 to the shroud ring 20 and to the base 40.

In operation, a power source (not shown) transmits rotary power to the hub 34 of the impeller assembly 10. The impeller assembly 10 rotates in a clockwise direction. The corrosive fluid then enters the impeller assembly 10 through the suction eye 22 of the shroud ring 20 due to a pressure gradient. As the corrosive fluid passes through the suction eye 22 it flows towards the conical hub 50, where the flow of the corrosive fluid is altered in a direction substantially 90° from the rotational axis of the impeller assembly 10. The corrosive fluid then flows in a radially outward direction through channels bounded by the base 40, the shroud ring 20, and by adjacent sets of blades 60, so as to form outlets 70 through which the corrosive fluid is discharged. The corrosive fluid discharged from the impeller assembly 10 can be collected in a housing (not shown) so as to transport the corrosive fluid to some other location.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An impeller made of corrosion resistant material used to transmit corrosive fluids, the impeller comprising:

a base having at least a conical portion, said base mountable for rotation about an axis;

an annular array of impeller blades being inclined with respect to a radius of the annular array of impeller blades, and backwardly inclined with respect to a rotational direction of the impeller, said annular array of impeller blades centered on the rotational axis, said impeller blades having axial ends, one axial end of said annular array of impeller blades connected to said base; and a shroud ring connected to the other axial end of said annular array of impeller blades wherein each of said impeller blades, said base and said shroud ring are constructed of fiberglass reinforced plastic, and wherein said blades are integrally formed with said base and shroud ring.

2. An impeller as recited in claim 1, wherein said annular array of impeller blades are equally spaced apart from each other.

3. An impeller as recited in claim 1, wherein said conical portion has an apex, said apex, when viewed in cross-section, forms an angle of 120°.

4. An impeller as recited in claim 1, wherein said conical portion has a periphery that is adjacent to an inlet edge of each of said impeller blades.

5. An impeller as recited in claim 1, wherein said conical portion has an axis of symmetry coincident with the rotational axis.

6. An impeller made of corrosion resistant fiberglass reinforced plastic used to transmit corrosive fluids, the impeller comprising:

an annular array of impeller blades being inclined with respect to a radius of the annular array of impeller blades, and inclined backwardly with respect to a direction of rotation of said impeller, said annular array of impeller blades centered on a rotational axis;

a base;

a shroud ring;

wherein said impeller blades are integrally connected to both of said shroud ring and said base so as to form outlets, and so as to reduce blade stress; and means for redirecting a flow of fluid entering the impeller by substantially 90°.

7. An impeller as recited in claim 6, wherein said annular array of impeller blades are equally spaced apart from each other.

8. An impeller as recited in claim 6, further comprising means for rotating the impeller.

* * * * *